United States Patent [19]

Russell

[11] Patent Number: 4,467,554

[45] Date of Patent: Aug. 28, 1984

[54] SPINNING TOY

[76] Inventor: James R. Russell, Apt. 401, 214 Agnes St., New Westminster, British Columbia, Canada, V3L 1E6

[21] Appl. No.: 541,481

[22] Filed: Oct. 17, 1983

Related U.S. Application Data

[63] Continuation-in-part of Ser. No. 361,419, Mar. 24, 1982, abandoned.

[51] Int. Cl.[3] ..... A63H 1/02

[52] U.S. Cl. ..... 446/242; 446/260

[58] Field of Search ..... 46/201, 202, 206, 69, 46/67, 208, 47, 48, 49, 50, 64, 65

[56] References Cited

U.S. PATENT DOCUMENTS

| | | | |
|---|---|---|---|
| 1,025,299 | 5/1912 | Pearsall et al. | 46/69 |
| 1,559,232 | 10/1925 | Esper | 46/69 |
| 2,826,860 | 3/1958 | Ashley et al. | 46/206 X |
| 4,228,616 | 10/1980 | Wilson | 46/201 X |

*Primary Examiner*—Mickey Yu

*Attorney, Agent, or Firm*—Barrigar & Oyen

[57] ABSTRACT

This invention is a toy in which two principal assemblies of parts are made to counter-rotate by a concentric internal coil spring, previously wound up by hand, whose tension is maintained by a one-way clutch and is released when the weight of the toy, when it is placed on a flat surface, disengages the clutch. A carrying handle, in the form of a miniature fence of posts and railings, is attached to the upper assembly. A mechanism is incorporated to free the inner end of the spring from its arbor when the energy of the spring is spent, so that the assemblies may continue to counter-rotate by inertia without damage to the spring. The toy is equipped with a lighting system of flashing light-bulbs around the perimeter and in a central transparent cupola, supplied with energy from flashlight-type electrical batteries in a central tubular shaft through a switch on the upper assembly. A tricycle supporting gear supports and stabilizes the toy when in operation, consisting of three hollow spheres on radial axles in the base, or of three hollow hemispheres on the lower face of an annular plate attached to the base of the lower assembly. All parts except light bulbs, batteries, wiring, contact parts, switch, and parts necessarily made of metal such as springs, axles, a ring carrying a hook to engage the inner end of the driving spring, and bolts for assembly, may be made of impact-resistant synthetic insulating plastic material by injection-molding or other appropriate process. External parts are covered with paint to resemble glittering metal, and illumination holes in the rim of the upper assembly are covered with thin tinted transparent plastic film.

3 Claims, 8 Drawing Figures

SPINNING TOY

CROSS-REFERENCE TO RELATED APPLICATION

This is a continuation-in-part of U.S. application Ser. No. 361,419 filed Mar. 24, 1982 now abandoned.

FIELD OF THE INVENTION

This invention is a children's toy of spinning type, comprising two principal assemblies of components, both having exteriors painted to resemble glittering metal, one axially positioned above the other, the upper having a hollow truncated right circular cone, or alternatively, a hollow convex part, integral with a tubular shaft revolvable within a hollow cylindrical part in the lower assembly, the two assemblies being made to rotate in opposite directions by an internal coil spring wound up by hand.

The toy is set in motion by being placed on a flat surface, its weight acting to disengage a one-way ratchet clutch theretofore preventing counter-rotation.

SUMMARY OF THE INVENTION

A miniature fence of posts and railings attached to the outer surface of the upper assembly surrounding the centre acts as a carrying handle. A lighting system provides flashing lights around the rim of the upper assembly and in a transparent cupola in the centre of the upper assembly, removable for replacement of the bulb or flashlight batteries in the tubular shaft. A switch on the exterior controls the lights.

Stability and support are provided by a tricycle supporting gear consisting of three equidistantly-spaced hollow spheres on radial axles in the lower assembly, or alternatively, by three equidistantly-spaced hollow hemispheres on the lower surface of an annular plate attached to the lower assembly.

Revolving toys are driven in many ways—by an external spring, by pumping an upper handle to spin a top through a twisted strip of metal operating in a slot, by spinning a propeller-type part by a string wound on a drum, by a hand-cranked gear train, or by a miniature gasoline engine.

The toy described herein is driven by a coil spring concentric between the two assemblies, its inner end detachable from its rotor, its outer end firmly connected to a component of the lower assembly.

The toy is wound up by the operator holding the lower assembly with one hand and revolving the upper assembly with the other, using short rods projecting from the upper surface of the cone or convex part as crankpins to put tension on the coil spring. A one-way ratchet clutch in the lower assembly maintains the tension.

The toy is then held in one hand by the miniature fence, the lights switched on, and the toy is placed on a flat surface. Its weight causes a sliding cylinder in the lower assembly to disengage the ratchet clutch, allowing the coil spring to counter-rotate the two assemblies.

The bulk of the weight, after the ratchet clutch has been disengaged, is borne by the tricycle supporting gear, which also gives the toy stability while it is operating.

BRIEF DESCRIPTION OF THE DRAWINGS

In drawings which illustrate embodiments of the invention.

DESCRIPTION OF THE PREFERRED EMBODIMENT

Figure 1:
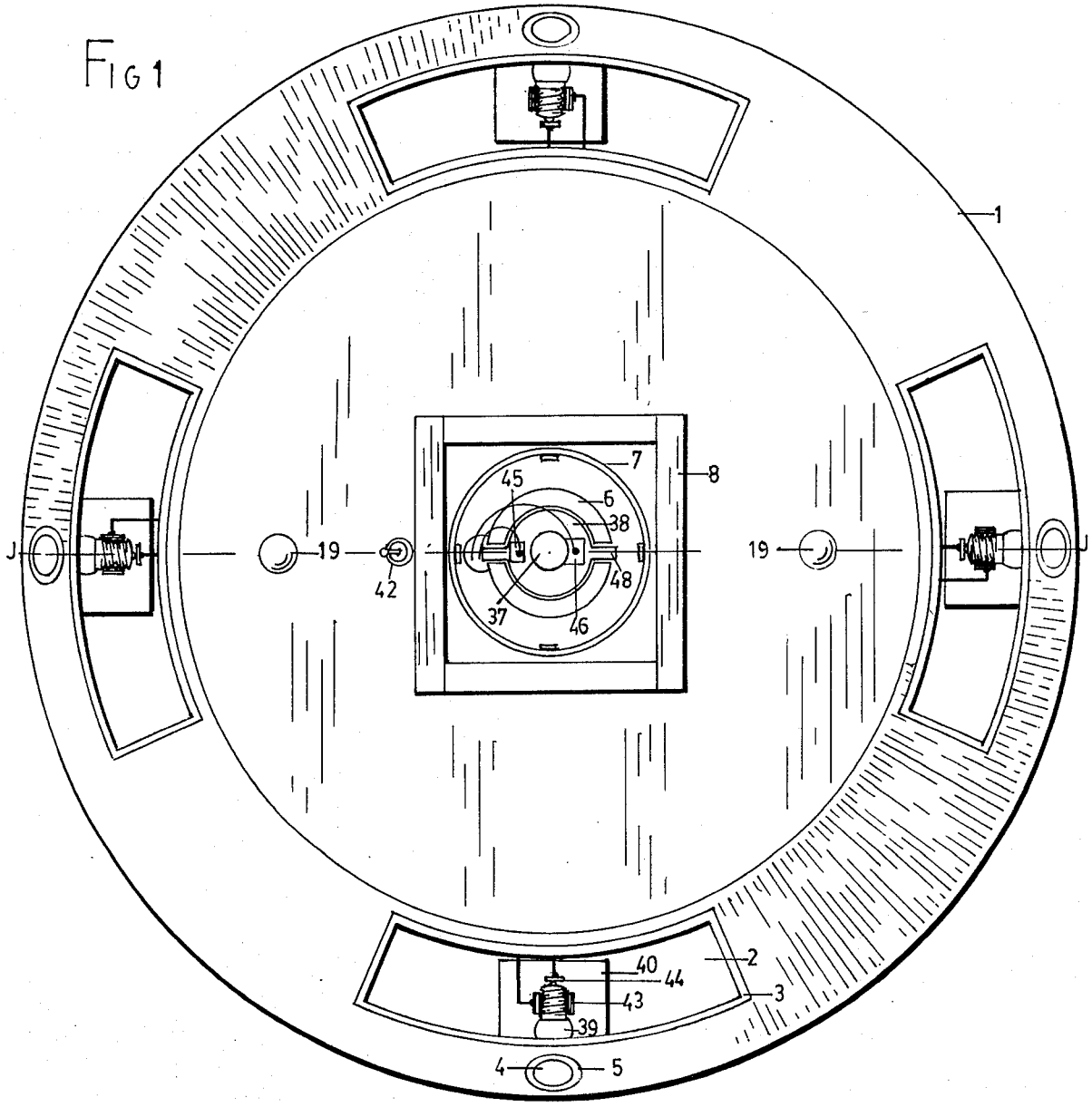
FIG. 1 is a top plan view showing a hollow truncated right circular cone in the upper assembly.
Figure 2:
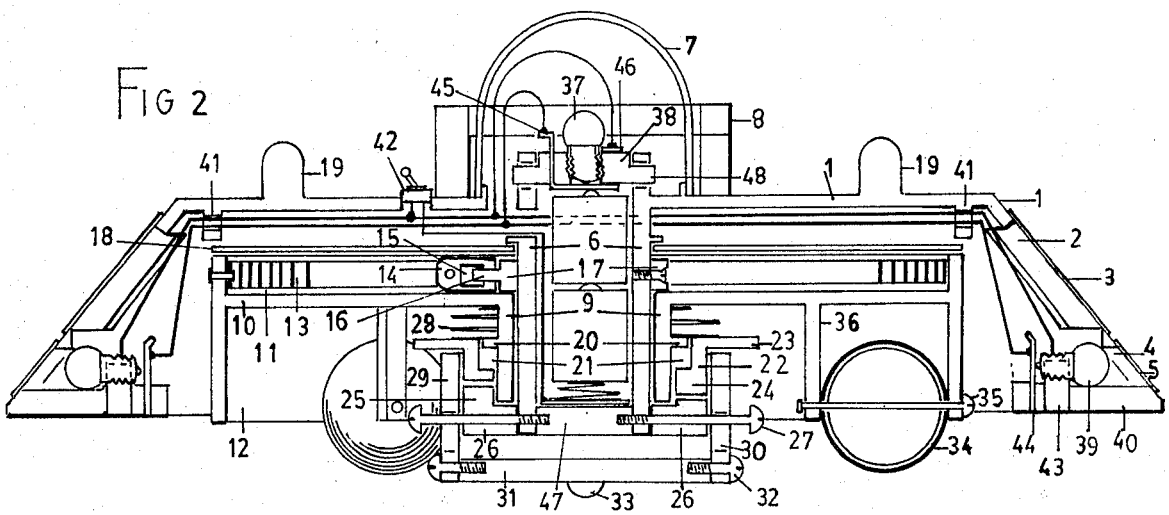
FIG. 2 is an elevation in section through J—J of FIG. 1, showing a tricycle supporting gear of hollow spheres in the lower assembly.
Figure 3:
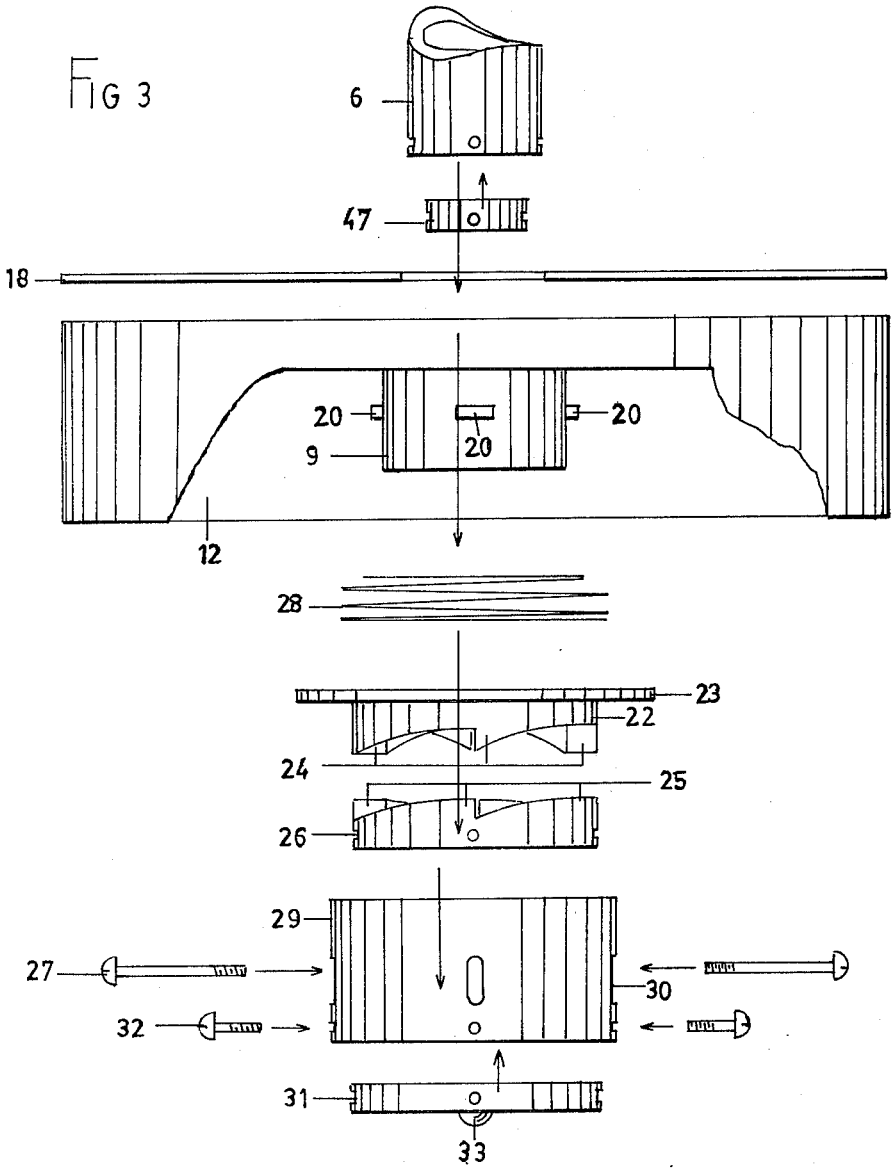
FIG. 3 is an exploded view of the one-way ratchet clutch and the disengaging cylinder.
Figure 4:
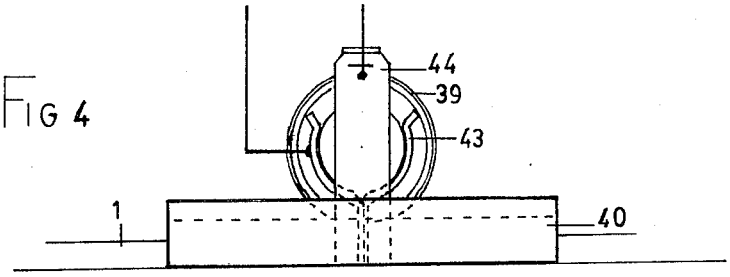
FIG. 4 is a view from the inside through J—J of FIG. 1 showing a perimeter bulb and bracket.
Figure 5:
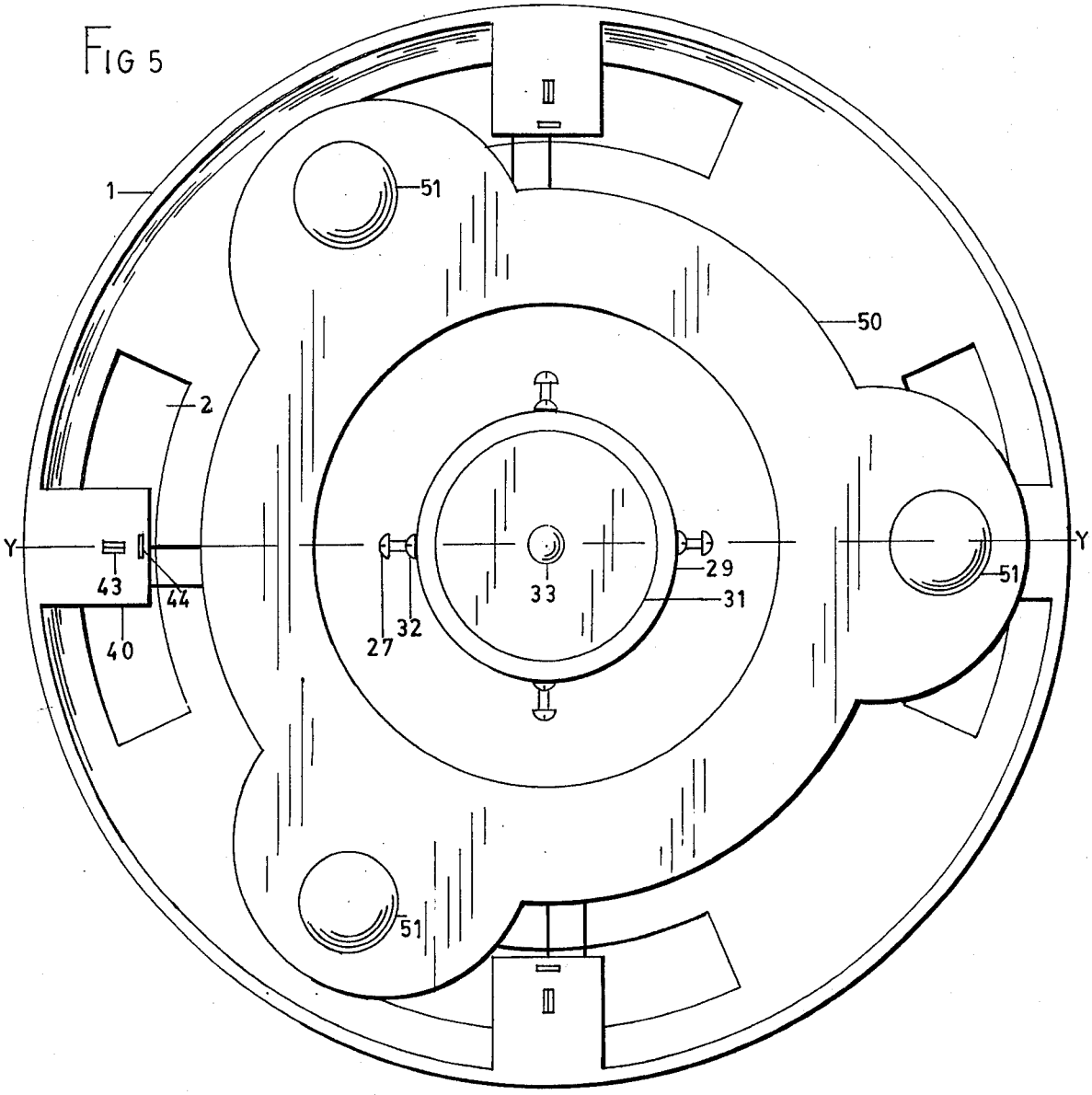
FIG. 5 is a bottom plan view showing a supporting gear consisting of three hollow hemispheres on an annular plate attached to the lower assembly.
Figure 6:
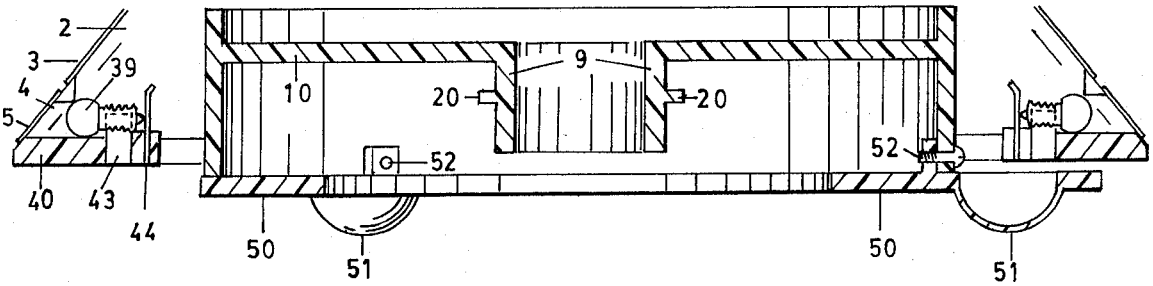
FIG. 6 is a part elevation in section through Y—Y of FIG. 5 showing the annular plate and hemispheres, and a method of attaching the plate to the lower assembly.
Figure 7:
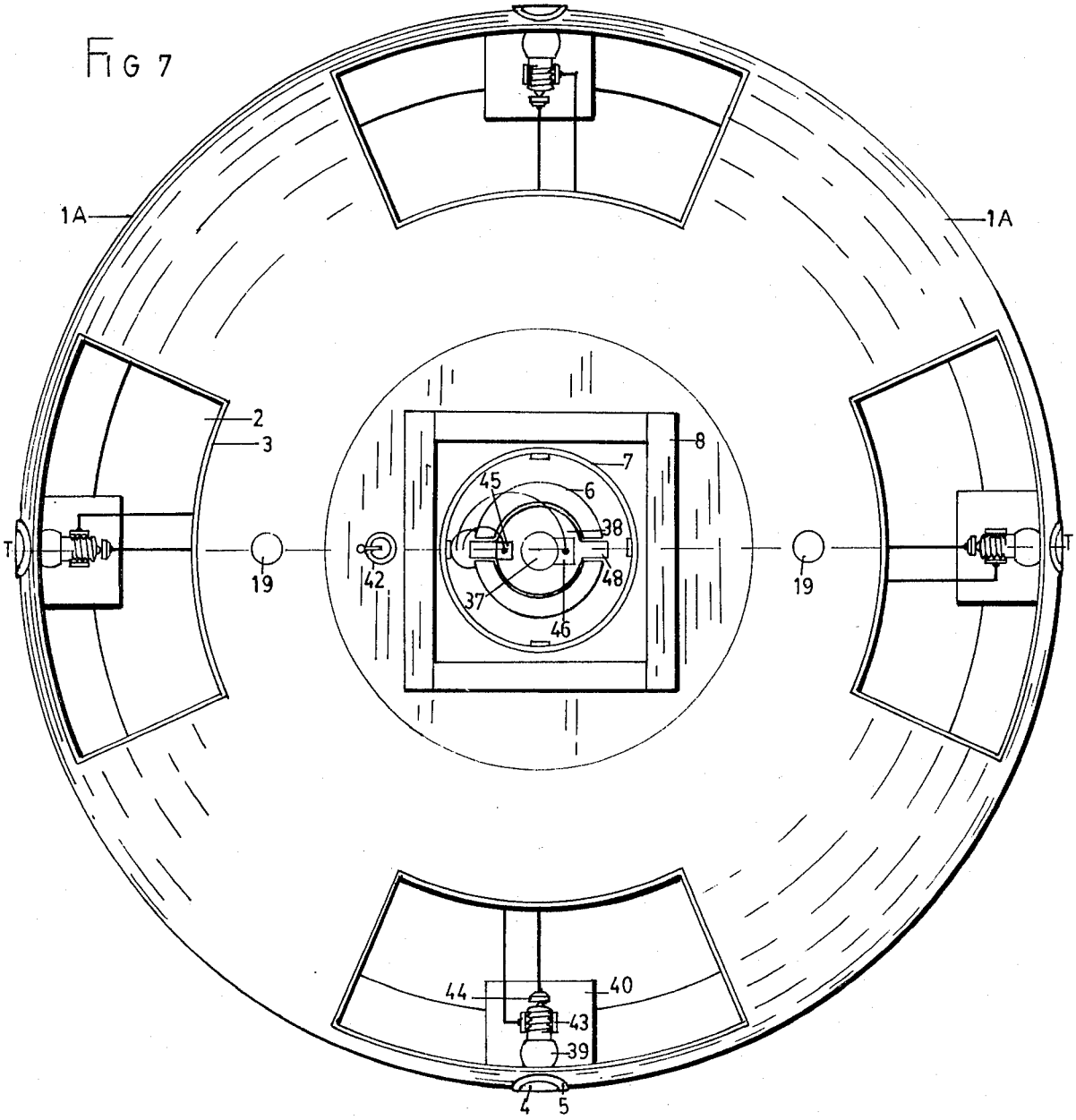
FIG. 7 is a top plan view showing a hollow convex part in the upper assembly.
Figure 8:
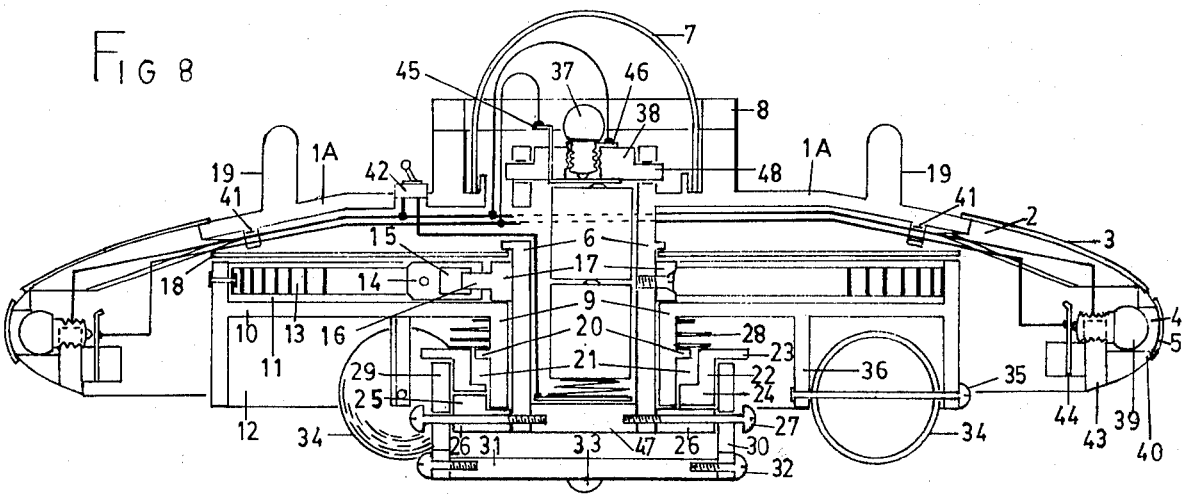
FIG. 8 is an elevation in section through T—T of FIG. 7, showing the convex part in an embodiment having a tricycle supporting gear as in FIG. 2.

The embodiments illustrated have a spinner, preferably a hollow truncated right circular cone, 1, or alternatively, a hollow convex part, 1A, of diameter several times its height, having window apertures, 2, of approximately rectangular shape, covered by strips of tinted transparent film, 3, and circular illumination holes, 4, covered by discs of tinted transparent film, 5, in the bevel of the cone or rim of the convex part.

The cone or convex part is centrally axially pierced by an integral tubular shaft, 6. A removable transparent plastic cupola, 7, is centrally positioned on the exterior of the cone or convex part, surrounded by a miniature fence of posts and railings, 8, surrounding the centre and either integral with the cone or convex part or connected to it by a plurality of bolts, said fence usable as a carrying handle.

A "base", comprising a hollow cylinder, 9, loosely revolvable on the tubular shaft, is integral with a disc, 10, which has integral with it on its perimeter a cylindrical part forming two hollow chambers, 11 proximal to the cone or convex part and 12 distal from it.

A coil spring, 13, is concentrically contained in the chamber 11 and its outer end is riveted to the inner wall of the chamber. A reinforcing part, 14, having a slot, 15, is riveted to the inner end of the spring, the slot enterable by a hook-like projection, 16, from the perimeter of a rotor, 17, in the form of a ring concentric over and attached to, the tubular shaft by a set-screw.

The inner end of the coil spring is bent inward toward the tubular shaft to force the reinforcing part to maintain riding contact with the periphery of the rotor to ensure entry of the hook-like projection into the slot 15 when the upper assembly is revolved to put tension on the spring. A disc, 18, is concentric with and freely revolvable on, the tubular shaft to retain the spring in the chamber 11.

Two short cylindrical rods, 19, project from the upper surface of the cone or convex part near the perimeter, usable as crankpins to revolve the upper assembly by hand to put tension on the spring.

Four projections or driving lugs, 20, equidistantly spaced on the perimeter of the hollow cylinder 9, fit loosely into longitudinal slots, 21, in the inside wall of a cylindrical sleeve, 22, which is rotated by the driving lugs and is freely slidable over the hollow cylinder. The slots are open at the end of the sleeve proximal to the disc 10, and are of greater length than the length of the teeth of a ratchet clutch described below. The sleeve has a flange, 23, extending outward radially from the end proximal to the disc 10, and has projecting axially from its distal end, a plurality of ratchet teeth, 24, matable with a plurality of ratchet teeth, 25, projecting axially from the proximal end of a cylindrical boss, 26, fitting concentrically over and attached to, the tubular shaft by a plurality of bolts, 27. A light spiral spring, 28, is concentrically positioned between the disc 10 and the flange to maintain the pluralities of ratchet teeth in mating contact.

A "disengaging means" comprising an overall hollow cylinder, 29, is freely slidable axially over the boss and sleeve, and is rotated by the boss and tubular shaft through the plurality of bolts 27 which pass through longitudinal slots, 30, in the wall of the overall cylinder, of sufficient length to permit the end of the overall cylinder proximal to the disc to contact the flange and move the sleeve axially along the exterior of the hollow cylinder 9, sufficiently to separate the pluralities of ratchet teeth, disengaging the clutch and setting the toy in motion.

A circular plug, 31, closes the distal end of the overall hollow cylinder, is attached to it by a plurality of bolts, 32, and has a hemispherical projection, 33, on the centre of its distal surface for contacting a flat surface on which the toy is placed.

Three hollow spheres, 34, equidistantly spaced, ride on axles, 35, radially disposed, piercing the wall of the distal chamber 12 and internal brackets, 36, integral with the disc 10, to form a tricycle supporting gear in the lower part of the lower assembly and to provide stability.

Alternatively, the supporting gear may consist of an annular plate, 50, having three hollow hemispheres, 51, equidistantly spaced, integral with it on its lower surface and having a plurality of brackets on its upper surface with which it is connected to the distal end of the distal chamber by a plurality of bolts, 52.

A lighting system is provided by a flashlight-type filament-flasher light-bulb, 37, positioned in a metal holder, 46, in a cylindrical insulating plug, 38, which closes the upper end of the tubular shaft, and by a plurality of similar bulbs, 39, on brackets, 40, integral with and disposed around, the inner surface of the cone or convex part at the perimeter, to supply light through the window apertures 2 and holes 4.

Each perimeter bulb is held in place by being pressed between a pair of semicircular metal clips, 43, set into slots in the brackets 40, which make electrical contact with the metal exteriors of the bulbs. Metal strips, 44, set into transverse slots in the brackets, provide electrical contact with the central terminals of the bulbs.

The plug 38 has a metal strip, 45, on its lower face, which makes simultaneous electrical contact with the central terminal of the bulb 37 and the central terminal at the top of the uppermost of flashlight-type electric batteries in the tubular shaft, which energize the bulbs. This strip is bent and one end passes through a slot in the plug to the exterior.

The metal strips 44 are parallel-connected by wiring to the strip 45. The bulb-holders 43 and 46 are parallel-connected by wiring to one of the terminals of an external switch, 42. The other switch terminal is connected by wiring through a hole in the tubular shaft to a metal disc in the base of the tubular shaft which contacts the bottom terminal of the bottommost battery in the shaft through a light spiral spring. Brackets 41 on the inner surface of the cone or convex part, support the wiring and hold it in place.

The lower end of the tubular shaft is closed by a circular plug, 47, held in place by the plurality of bolts 27. The plug 38 has two peripheral lugs, 48, which fit into L-shaped slots in the wall of the upper end of the tubular shaft. A partial turn holds the plug in place.

After the toy has been set in motion and the energy of the spring is spent, the hook-like projection 16 on the rotor 17 disengages from the slot 15 in the reinforcing part, and the two assemblies continue to counter-rotate by inertia, and the spring escapes damage.

Most of the components of this invention, except light bulbs, batteries, and parts necessarily made of metal such as wiring, contact strips, springs, bolts and rivets, and the rotor or ring carrying the hook-like projection, may be made of an insulating, impact-resistant, hard-setting synthetic plastic material by injection-molding or other appropriate process.

I claim:

1. A spinning toy comprising:

(a) a base;

(b) a spinner rotatable with respect to said base;

(c) a spring connecting said spinner to said base; and, (d) clutch means for maintaining said spinner fixed with respect to said base, said clutch means being disengageable, thereby enabling said spring to rotate said spinner with respect to said base; said clutch means comprising:

(i) a first portion affixed to said spinner and rotatable therewith;

(ii) a second portion (A) drivingly engageable by said first portion in only one direction of rotation; and, (B) drivingly engageable with said base portion; whereby rotation of said spinner, in said one direction, with respect to said base portion, places said spring in tension; and, (iii) disengaging means for disengaging said clutch to enable said spring to rotate said spinner freely with respect to said base; said disengaging means extending between one of said clutch portions and a point below said base, whereby placement of the toy on a flat surface urges said one clutch portion away from the other of said clutch portions.

2. A spinning toy as defined in claim 1, further comprising bias spring means for maintaining engagement of said first and second clutch portions, said bias spring means being insufficient to maintain said engagement when said disengaging means urges said clutch portions away from each other.

3. A spinning toy, comprising:

(a) a base;

(b) a spinner rotatable with respect to said base;

(c) a spring connecting said spinner to said base;

(d) a clutch, comprising:

(i) a first portion affixed to said spinner and rotatable therewith; and, (ii) a second portion drivingly engageable with said base portion and with said first clutch portion;

said first and second portions having mating ratchet teeth which enable rotation of said portions, when engaged, in one direction only, thereby placing said spring in tension; and, (e) clutch disengaging means extending between one of said clutch portions and a point below said base, whereby placement of the toy on a flat surface urges said one clutch portion away from the other of said clutch portions.

* * * * *